US010678186B2

(12) United States Patent
Taguchi et al.

(10) Patent No.: US 10,678,186 B2
(45) Date of Patent: Jun. 9, 2020

(54) IMAGE FORMING APPARATUS INCLUDING A REPLACEMENT UNIT

(71) Applicant: SHARP KABUSHIKI KAISHA, Sakai, Osaka (JP)

(72) Inventors: Noriaki Taguchi, Sakai (JP); Shinichi Takeda, Sakai (JP); Hiroki Kanemitsu, Sakai (JP); Yuji Sawa, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 0 days.

(21) Appl. No.: 16/257,035

(22) Filed: Jan. 24, 2019

(65) Prior Publication Data

US 2019/0235440 A1 Aug. 1, 2019

(30) Foreign Application Priority Data

Jan. 26, 2018 (JP) ..... 2018-011538

(51) Int. Cl.
*G03G 21/20* (2006.01)
*G03G 21/16* (2006.01)

(52) U.S. Cl.
CPC ..... *G03G 21/206* (2013.01); *G03G 21/1695* (2013.01); *G03G 2221/1645* (2013.01)

(58) Field of Classification Search
CPC ..... G03G 21/206; G03G 2221/1645
See application file for complete search history.

(56) References Cited

U.S. PATENT DOCUMENTS

2011/0274463 A1* 11/2011 Taguchi ..... G03G 21/206 399/122
2013/0084099 A1* 4/2013 Hashimoto ..... G03G 15/0194 399/110

FOREIGN PATENT DOCUMENTS

JP 2000-019903 A 1/2000

* cited by examiner

*Primary Examiner* — Susan S Lee
(74) *Attorney, Agent, or Firm* — ScienBiziP, P.C.

(57) ABSTRACT

An image forming apparatus includes a replacement unit (developing unit) that is provided to be freely inserted into and extracted from an apparatus body, and the replacement unit is provided with a separation duct wall that constitutes a collection path through which powder scattering in the apparatus body is collected.

9 Claims, 7 Drawing Sheets

IMAGE FORMING APPARATUS INCLUDING A REPLACEMENT UNIT

BACKGROUND

1. Field

The present disclosure relates to an image forming apparatus including a replacement unit that is provided such that the replacement unit can be inserted into and extracted from an apparatus body.

More specifically, the present disclosure relates to an image forming apparatus in which a side wall of a duct portion that communicates with a duct provided in an apparatus body is formed of a replacement unit and thus it is possible to separate the side wall from the apparatus body by separating the replacement unit from the apparatus body.

2. Description of the Related Art

For example, in an image forming operation by an image forming apparatus, a developing roller holding toner on a surface thereof rotates at a high speed to supply the toner to an electrostatic latent image portion on a photosensitive drum. Since the photosensitive drum also rotates at a high speed at this time, there is a possibility that the toner from the developing roller is not delivered to the photosensitive drum smoothly and a portion of the toner scatters in the apparatus body if there is a variation in the electric charge amount of toner or the diameter of toner particles.

The scattering toner floats in the apparatus body and adheres to a feed roller, a detecting sensor, or the like, and thus contamination of a paper sheet or a detection error of the detecting sensor may occur. Therefore, an image forming apparatus, in which an apparatus body is provided with a suction duct that sucks scattering toner, is disclosed (for example, refer to Japanese Unexamined Patent Application Publication No. 2000-19903).

Japanese Unexamined Patent Application Publication No. 2000-19903 discloses an image forming apparatus in which an upper suction opening and a lower suction opening that are attached to a duct (suction duct) are provided in the vicinity of upper and lower brushes that come into slide-contact with a resist roller and paper dust accumulated in the vicinity of the resist roller is sucked and collected into a collection unit while scattering toner is collected by driving a fan.

According to the image forming apparatus described in Japanese Unexamined Patent Application Publication No. 2000-19903, a space for installing a dedicated suction duct for sucking toner needs to be ensured in the apparatus body. However, a lot of components such as a photosensitive drum, a developing device, an exposure unit, a cleaner unit, an electrification unit, an intermediate transfer belt unit, a fixation unit, and a secondary transfer unit are disposed in an image forming unit in the apparatus body. Therefore, there is a problem that it is difficult to separately ensure an installation space for the suction duct and thus it is difficult to achieve reduction in size.

In addition, according to the image forming apparatus described in Japanese Unexamined Patent Application Publication No. 2000-19903, it is not possible to detach the suction duct or a side wall, which constitutes the suction duct, from the apparatus body. Therefore, there is a problem that it is not possible to sufficiently remove toner adhering to an inner portion of the duct and toner adhering to a duct wall scatters again.

It is desirable to provide a duct mechanism that enables reduction in size of an image forming apparatus. Furthermore, it is desirable to provide a duct mechanism with which it is easy to perform cleaning since an inner wall portion of a duct is opened and exposed with a simple mechanism.

SUMMARY

According to an aspect of the disclosure, there is provided an image forming apparatus including a replacement unit that is capable of being inserted into and extracted from an apparatus body. The replacement unit is provided with a separation duct wall that forms an air blowing path between the separation duct wall and a body interior wall provided in an installation space for the replacement unit in the apparatus body when the replacement unit is installed in the apparatus body.

DESCRIPTION OF THE EMBODIMENTS

Hereinafter, an embodiment of the present disclosure will be described with reference to drawings.

Embodiment 1

Figure 1:
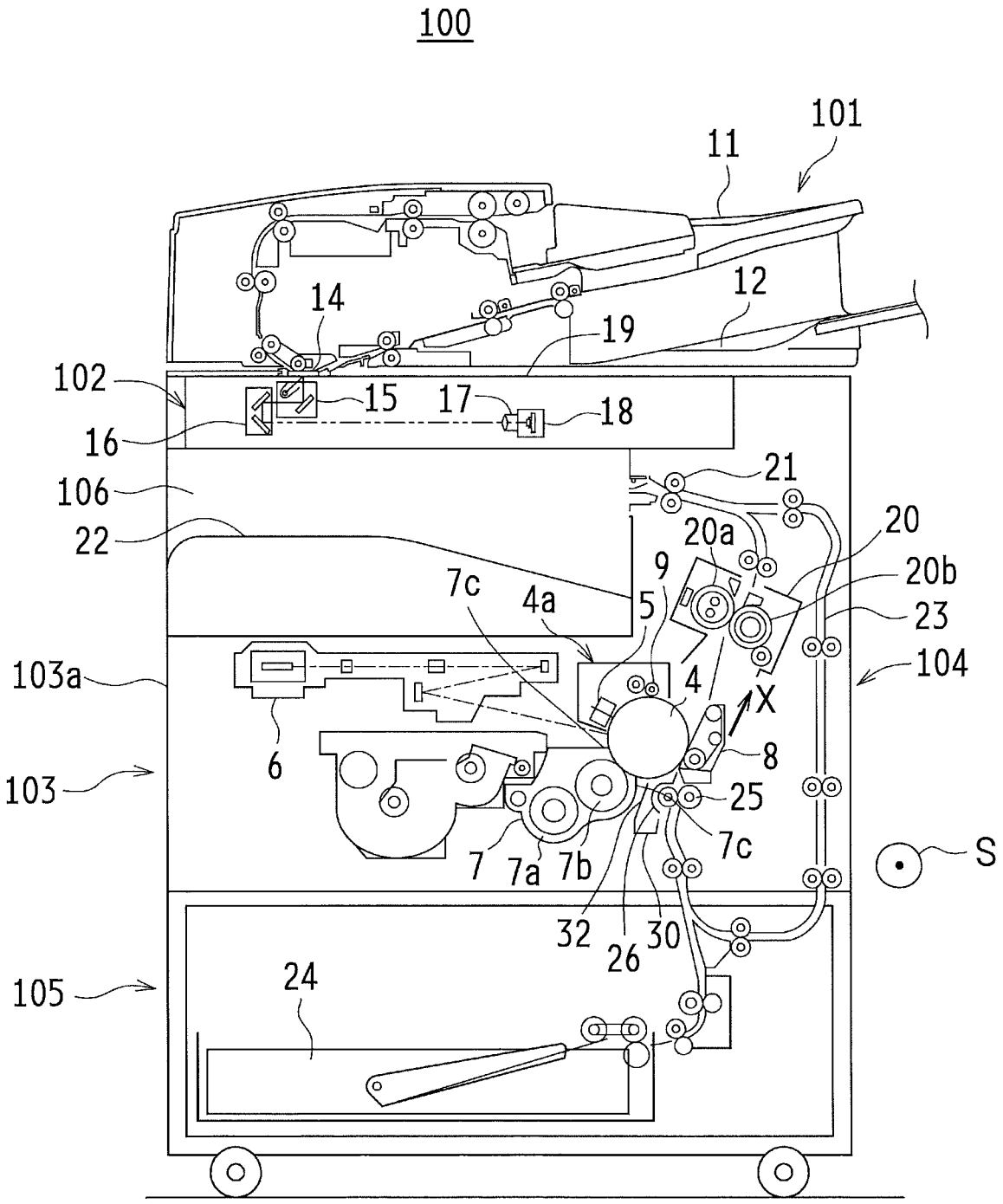
FIG. 1 is a schematic sectional view of an image forming apparatus according to Embodiment 1 of the present disclosure.

FIG. 1 is a schematic sectional view of an image forming apparatus according to Embodiment 1 of the present disclosure. In Embodiment 1, a case where the present disclosure is applied to an image forming apparatus outputting a monochrome image will be described.

An image forming apparatus 100 acquires image data read from a document or image data received from the outside and forms a monochrome image indicated by the image data on a paper sheet. The configuration of the image forming apparatus 100 is roughly divided into a document transportation unit (ADF) 101, an image reading device (document reading device) 102, an image forming unit 103, a paper sheet transportation unit 104, and a sheet feeding unit 105.

In addition, the image forming apparatus 100 is an in-body paper discharge type image forming apparatus in which in-body paper discharge space 106 having a U-shaped section is formed between the image reading device 102 and the image forming unit 103.

When at least one document is set on a document tray 11, the document transportation unit 101 extracts the document from the document tray 11 and transports the document in a one-by-one manner. The document is guided onto a first platen glass 14 of the image reading device 102, is caused to pass through a position above the first platen glass 14, and is discharged to a discharge tray 12.

Regarding the image reading device 102, an optical unit including a first scanning unit 15 and a second scanning unit 16 is disposed below the first platen glass 14, a surface of a document is exposed to light from a light source of the first scanning unit 15 when the document passes through the position above the first platen glass 14, light reflected from the surface of the document is guided to an image forming lens 17 by mirrors of the first and second scanning units 15 and 16, and the same image as an image on the surface of the document is formed on a charge coupled device (CCD) 18 by the image forming lens 17. The CCD 18 repeatedly reads the image on the surface of the document in a main scanning direction and outputs image data indicating the image on the surface of the document.

In addition, in a case where the document is placed on a second platen glass 19 on an upper surface of the image reading device 102, the surface of the document on the second platen glass 19 is exposed to light from the first scanning unit 15 with the first and second scanning units 15 and 16 moved in a sub scanning direction while maintaining a predetermined speed relationship therebetween, light reflected from the surface of the document is reflected again by the first and second scanning units 15 and 16 such that the light is guided to the image forming lens 17, and the same image as an image on the surface of the document is formed on the CCD 18 by the image forming lens 17.

The image data output from the CCD 18 is output to the image forming unit 103 after being subject to various kinds of image processing performed by a control circuit of a microcomputer or the like.

A photosensitive drum 4 is disposed in an approximately central part of the image forming unit 103 and an electrification unit 5, an optical scanning unit 6, a developing unit (developing device) 7, a transfer unit 8, and a cleaning unit 9 are disposed in the vicinity of the photosensitive drum 4.

The electrification unit 5 uniformly charges a surface of the photosensitive drum 4. The optical scanning unit 6 inputs image data and scans the uniformly charged photosensitive drum 4 with a light beam while modulating the intensity of the light beam corresponding to the image data so as to write an electrostatic latent image. The developing unit 7 develops the electrostatic latent image on the photosensitive drum 4 with a developer (toner) and forms a developer image on the photosensitive drum 4. The transfer unit 8 transfers the developer image on the photosensitive drum 4 onto a paper sheet while transporting the paper sheet with the paper sheet interposed between the transfer unit 8 and the photosensitive drum 4. The cleaning unit 9 removes the developer remaining on the photosensitive drum 4 such that a new developer image can be formed on the photosensitive drum 4.

A fixation device 20 is disposed in an upper part of the image forming unit 103. In the fixation device 20, the paper sheet on which the image has been transferred is interposed between a fixation roller 20*a* including a heat source and a pressing roller 20*b* and the developer image transferred onto the paper sheet is fixed by means of heat and pressure.

The paper sheet after the fixation is transported to a position above paper sheet transportation rollers and is discharged to a discharge tray 22 in the in-body paper discharge space 106 by discharge rollers 21.

In addition, in a case where an image is formed on both surfaces of the paper sheet, the paper sheet is transported in a reverse direction while being inverted near the discharge rollers 21, is transported to an inversion transportation path 23, and is transported to the image forming unit 103 again after being inverted so that a developer image is transferred and fixed onto a rear surface of the paper sheet. Then, the paper sheet is discharged to the discharge tray 22 by the discharge rollers 21.

The sheet feeding unit 105 is provided with a paper feed tray 24 and a paper sheet is supplied from the paper feed tray 24 one by one. A paper sheet is temporarily stopped by resist rollers 25 out of the paper sheet transportation rollers which are provided in front of the photosensitive drum 4 and the transfer unit 8 and the paper sheet is supplied to a space between the photosensitive drum 4 and the transfer unit 8 at the timing of transfer so that the developer image on the photosensitive drum 4 is transferred to the paper sheet.

The resist rollers 25 are provided with a cover wall 26 that covers the resist rollers 25 and extends in a paper sheet transportation direction X. The cover wall 26 is disposed while extending such that the cover wall 26 is hung down from the vicinity of the photosensitive drum 4 and an extension portion thereof is configured such that the resist rollers 25 are exposed at an end (exposure opening).

In addition, a paper dust collecting unit 30, which is provided with, for example, a cleaning member 31 (for example, cleaning pad) which is a cleaning member for removing paper dust adhering to surfaces of the resist rollers 25, is disposed below the resist rollers 25.

In the image forming apparatus 100 configured as described above, at least the photosensitive drum 4, the developing unit 7, the paper dust collecting unit 30, and the like are configured as replacement units which are replaceable and can be freely inserted into and extracted from an apparatus body 103*a* (housing) of the image forming unit 103 in a direction perpendicular to the paper surface of FIG. 1 (that is, toward front side when viewed on paper) in consideration of component replacement and maintenance. That is, an insertion and extraction direction S of the replacement units is the same direction as axial directions of the paper sheet transportation rollers including the resist rollers 25 and is the same direction as longitudinal directions of the replacement units.

Although not shown, for example, a configuration, in which a guide rail portion (guide portion) is provided in the apparatus body 103*a* to extend in the insertion and extraction direction and a sliding portion that slides along the guide rail portion in the insertion and extraction direction is provided close to the replacement units, can be adopted as a mechanism for inserting and extracting the replacement units. In addition, each replacement unit may be provided with an attachment portion for fixing and attaching the replacement unit to a predetermined position after insertion. Examples of the attachment portion include a locking structure using a hooking mechanism, a fastening structure using a screw or the like, or an urging mechanism using an elastic member for bringing the replacement unit into contact with another component.

An installation space for the replacement units will be described.

The installation space for the replacement units provided in the apparatus body 103*a* needs to be larger than the replacement units to dispose the replacement units such that each replacements unit can be inserted and extracted with respect to a predetermined position.

In Embodiment 1, each of a photoreceptor unit 4*a* including the photosensitive drum 4, the developing unit 7, the paper dust collecting unit 30, and the transfer unit 8 is the replacement unit and the reason that the installation space is larger than the replacement units will be described while using the developing unit 7 as an example.

The developing unit 7 needs to be disposed in such a manner that a distance between a surface of a developing roller 7*b* and a surface of the photosensitive drum 4 of the photoreceptor unit 4*a* which is mounted in the apparatus body 103*a* in advance, that is, a developing gap becomes 2 mm or shorter, desirably 1 mm or shorter. However, the insertion and extraction direction of the developing unit 7 is the same as that of the photoreceptor unit 4*a*. Therefore, when performing an insertion and extraction operation while maintaining a predetermined developing gap, an end portion of the developing unit 7 or a toner scattering preventing wall 7*c*, which is provided to extend along an axial direction of the developing roller 7*b* for the purpose of preventing toner from scattering, may come into contact with the photosensitive drum 4 and the photosensitive drum 4 may be damaged. Therefore, a retreat guide space is formed to move the developing unit 7 such that insertion of the developing unit 7 is started when the developing unit 7 is at a position at which an initial developing gap is larger than a predetermined value, that is, when the developing unit 7 is at a retreat position with the developing roller 7*b* separated from the photosensitive drum 4 and the predetermined developing gap between the photosensitive drum 4 and the developing unit 7 is achieved immediately before the insertion of the developing unit 7 is finished in a case where the developing unit 7 is mounted into the apparatus body 103*a*. Since the retreat guide space needs to be provided, the installation space needs to be larger than the replacement units.

As the installation space for the developing unit 7, the photoreceptor unit 4*a*, and the paper dust collecting unit 30, one large installation space is provided in the apparatus body 103*a* instead of separated installation spaces respectively accommodating the replacement units because the developing unit 7, the photoreceptor unit 4*a*, and the paper dust collecting unit 30 are disposed to be close to each other (not shown).

Next, an example of a separation duct wall 32 according to the present disclosure will be described.

Figure 2:
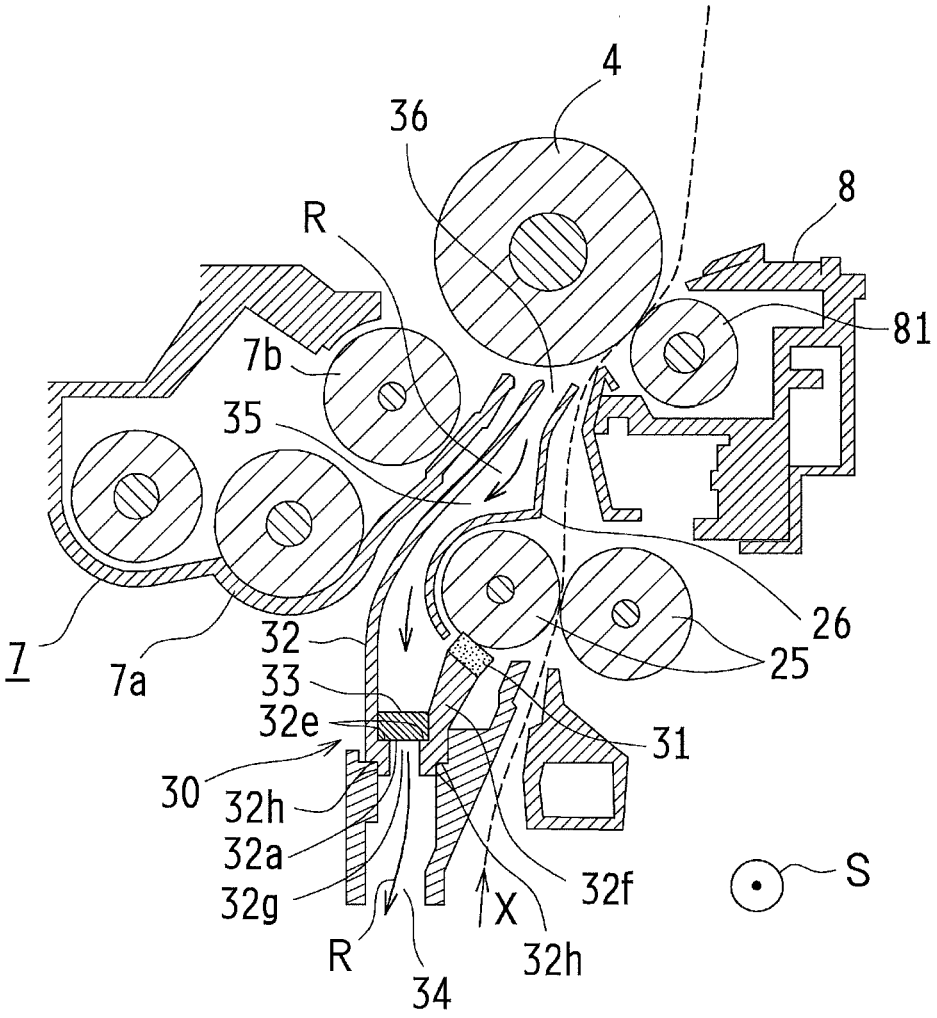
FIG. 2 is a schematic enlarged sectional view illustrating a main part of an image forming unit.

FIG. 2 is a schematic enlarged sectional view illustrating a main part of the image forming unit 103. Note that, a reference numeral "81" in FIG. 2 and FIG. 4, which will be described later, represents a transfer roller.

Figure 3:
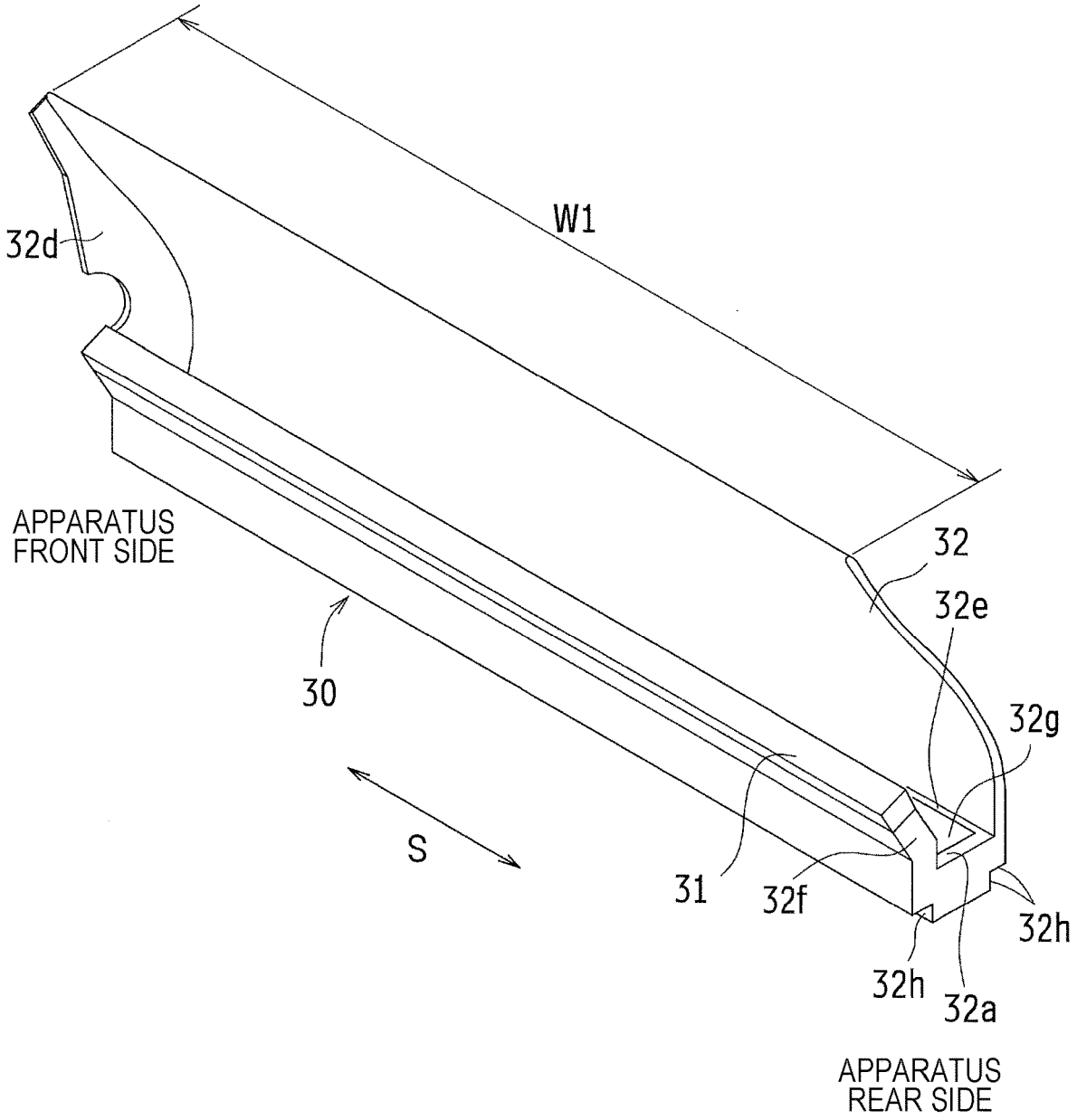
FIG. 3 is a perspective view of a paper dust collecting unit provided with a movable duct wall according to the present disclosure without a filter.

In addition, FIG. 3 is a perspective view of the paper dust collecting unit 30 provided with an example of the separation duct wall 32 according to the present disclosure and FIG. 3 illustrates a state where the paper dust collecting unit 30 with a filter for air cleaning (which will be described) detached therefrom has been extracted from the apparatus body 103*a* in the insertion and extraction direction S as seen from the image forming apparatus 100 side.

In Embodiment 1, a space between the developing unit 7 and the cover wall 26 (example of body interior wall) as shown in FIG. 2 is (part of) the installation space for the developing unit 7 and the installation space is provided with a guide portion that guides the developing unit 7 such that the developing roller 7*b* becomes close to the photosensitive drum 4 as the developing unit 7 becomes close to a predetermined installation position in the apparatus body 103*a* (not shown). That is, the space between the developing unit 7 and the cover wall 26 is a retreat space in an operation of inserting and extracting the developing unit 7 and becomes merely a dead space after the developing unit 7 is mounted into the apparatus body 103*a*.

In Embodiment 1, the paper dust collecting unit 30 which is provided below the resist rollers 25 is provided with the separation duct wall 32 to use the retreat space for the developing unit 7 (part of installation space) as a duct, which is an air blowing path connected to an apparatus fixation duct 34 provided in the apparatus body 103*a* (refer to FIG. 2). The separation duct wall 32 extends from a bottom portion 32*a* of the paper dust collecting unit 30 toward the photosensitive drum 4 positioned above the bottom portion 32*a* and the separation duct wall 32 is formed along a direction perpendicular to the paper surface (insertion and extraction direction S) toward a deeper side of FIG. 2, that is, along a longitudinal direction of the paper dust collecting unit 30 such that the separation duct wall 32 faces the cover wall 26. Note that, the longitudinal direction of the paper dust collecting unit 30 and the longitudinal direction of the separation duct wall 32 are parallel to a direction along rotation axes of the resist rollers 25 and a direction along a rotation axis of the photosensitive drum 4 and the separation duct wall 32 is formed along the longitudinal direction such that the width W1 (refer to FIG. 3) thereof becomes substantially the same as the width of the photosensitive drum 4 in an axial direction.

In addition, a side wall 32*d* (refer to FIG. 3) that controls the flow of air in the longitudinal direction of the separation duct wall 32 is formed on an end of the separation duct wall 32 in the longitudinal direction that is on a side on which an operation of inserting and extracting the paper dust collecting unit 30 is performed. Note that, in Embodiment 1, the side wall 32*d* is provided on only one end of the separation duct wall 32. However, the side wall 32*d* may be provided on opposite ends of the separation duct wall 32 and the rib-shaped side wall 32*d* may be provided on the central portion of the separation duct wall 32. In addition, the side wall 32*d* may be omitted in a case where the flow of air in the longitudinal direction of the separation duct wall 32 is controlled by a wall inside the apparatus (in this case, wall inside apparatus provided with surface perpendicular to replacement unit insertion and extraction direction) which forms the installation space for the replacement units provided in the apparatus body 103*a*.

Note that, as described above, the paper dust collecting unit 30 is the replacement unit as with the developing unit 7. Therefore, it is possible to effectively use the retreat space, which needs to be provided when mounting the developing unit 7, as a separation duct space 35, which is an air blowing path, when adopting a configuration in which the paper dust collecting unit 30 is mounted after the developing unit 7 is mounted into the apparatus body 103*a*.

For example, a unit housing 7*a* of the developing unit 7 may abut onto the separation duct wall 32 such that the unit housing 7*a* becomes not able to move when trying to move the developing unit 7 to the retreat position.

Next, the way in which air flowing in the separation duct space 35 flows will be described.

In Embodiment 1, the apparatus body 103*a* further includes the apparatus fixation duct 34 in which an air blowing fan (not shown) is provided and one end of the separation duct space 35, that is, one end of the separation duct space 35 in a direction orthogonal to the longitudinal direction of the separation duct wall 32 communicates with the apparatus fixation duct 34. In addition, an opening 36 that is open to an inner space of the apparatus body 103*a* is formed on a side opposite to a side of the separation duct space 35 at which the separation duct space 35 communicates with the apparatus fixation duct 34, air in the apparatus body 103*a* is sucked by the air blowing fan via the opening 36, and the sucked air is discharged to the outside of the apparatus body 103*a* via an exhaust port (not shown).

That is, a collection path R through which powder (toner, paper dust, or like) scattering in the apparatus body 103*a* is collected is formed in the separation duct space 35.

In addition, the bottom portion 32*a* of the paper dust collecting unit 30 is provided with a filter 33 that purifies air by removing (collecting) powder (toner, paper dust, or like) sucked via the opening 36.

A holding wall 32*f* for holding the filter 33 at a predetermined position is formed on the bottom portion 32*a* while being positioned on a side opposite to the separation duct wall 32 side. Communication ports 32*g* communicating with the apparatus fixation duct 34 and a filter holding portion 32*e* that holds the filter 33 are formed between the holding wall 32*f* of the bottom portion 32*a* and the separation duct wall 32. An insertion and extraction guide portion 32*h* for the paper dust collecting unit 30 is formed on a side of the bottom portion 32*a* that is opposite to the filter 33.

As with the separation duct wall 32, the filter 33 is formed along the longitudinal direction of the paper dust collecting unit 30 such that a width W1 thereof becomes substantially the same as an axial length of the photosensitive drum 4.

The plurality of communication ports 32*g* are formed in the longitudinal direction of the paper dust collecting unit 30 over a range of which the length is substantially the same as the axial length of the photosensitive drum 4 as with the filter 33. However, the number of the communication ports 32*g* may be one. In addition, a rib may be disposed between the separation duct wall 32 and the holding wall 32*f* such that one communication port 32*g* is provided with a plurality of communication ports and a configuration in which only one small communication port 32*g* is provided may also be adopted. In this case, the length of the filter 33 in the longitudinal direction may also be short in accordance with the size of the communication port 32*g*.

The holding wall 32*f* is formed such that the length thereof in a direction perpendicular to the longitudinal direction of the separation duct wall 32 is shorter than that of the separation duct wall 32. Therefore, when the paper dust collecting unit 30 is detached from the apparatus body 103*a*, the entire surface of the separation duct wall 32 is not blocked by the holding wall 32*f* and thus it is possible to easily remove toner or paper dust adhering to the surface of the separation duct wall 32. In addition, it is easy to reach the filter 33 installed on the bottom portion 32*a* and it is possible to easily clean and detach the filter 33.

In addition, the holding wall 32*f* extends toward the resist roller 25 (exposure opening in an end of cover wall 26 at which resist rollers 25 are exposed) from the bottom portion 32*a* and the cleaning member 31 that comes into contact with the resist rollers 25 and removes paper dust or the like adhering to the surfaces of the resist rollers 25 is disposed on a tip end of the holding wall 32*f*. As the cleaning member 31, an elastic porous member such as felt, sponge, non-woven fabric, or the like can be used.

A space may be provided between the cleaning member 31 and the end of the cover wall 26 (end on exposure opening side) such that paper dust adhering to the surfaces of the resist rollers 25 is collected to the filter 33 side.

Note that, the air blowing fan is installed between an exhaust port of the apparatus fixation duct 34 and the filter 33.

In Embodiment 1, the paper dust collecting unit 30 is provided with the separation duct wall 32 (that is, separation duct wall 32 is used together with paper dust collecting unit 30). However, the cleaning member 31 may be omitted from the paper dust collecting unit 30 and a dedicated replacement unit for the separation duct wall 32 may be provided. In this case, the paper dust collecting unit 30 may be provided at a different place.

According to Embodiment 1, the paper dust collecting unit 30, which is the replacement unit, is provided with the separation duct wall 32 such that the separation duct wall 32 is exposed while being not covered by the holding wall 32*f*. Therefore, it is possible to easily clean the separation duct wall 32 when the paper dust collecting unit 30 is detached from the apparatus body 103*a*. At this time, the cover wall 26 is also exposed inside the apparatus body 103*a* and thus it is possible to easily clean the cover wall 26. Therefore, it is easy to perform cleaning even when powder such as toner or paper dust adheres to the separation duct wall 32 and the cover wall 26.

In addition, since the separation duct wall 32 is formed on the paper dust collecting unit 30, it is possible to achieve reduction in the number of components or reduction in cost.

According to Embodiment 1, the separation duct wall 32 is provided with the filter 33 and the length of the holding wall 32*f*, which holds the filter 33, in a direction orthogonal to the longitudinal direction of the paper dust collecting unit 30 is shorter than that of the separation duct wall 32. Therefore, it is easy to reach the filter 33 and it is easy to clean the filter 33 and the separation duct wall 32. In addition, since the filter 33 is disposed close to an opening of the apparatus fixation duct 34 instead of the exhaust port of the apparatus fixation duct 34, a space between the filter 33 and the exhaust port is less likely to be contaminated by toner or paper dust. In addition, since the air blowing fan is installed in the apparatus fixation duct 34 which is on a downstream side of the installation position of the filter 33 and in which contamination is less likely to occur, the lifespan of the air blowing fan is less likely to be shortened due to toner or paper dust adhering to a rotation shaft portion of the air blowing fan.

In addition, according to Embodiment 1, it is possible to use the installation space (retreat space) of the developing unit 7 as a duct space and thus it is possible to efficiently use the space.

Embodiment 2

Figure 4:
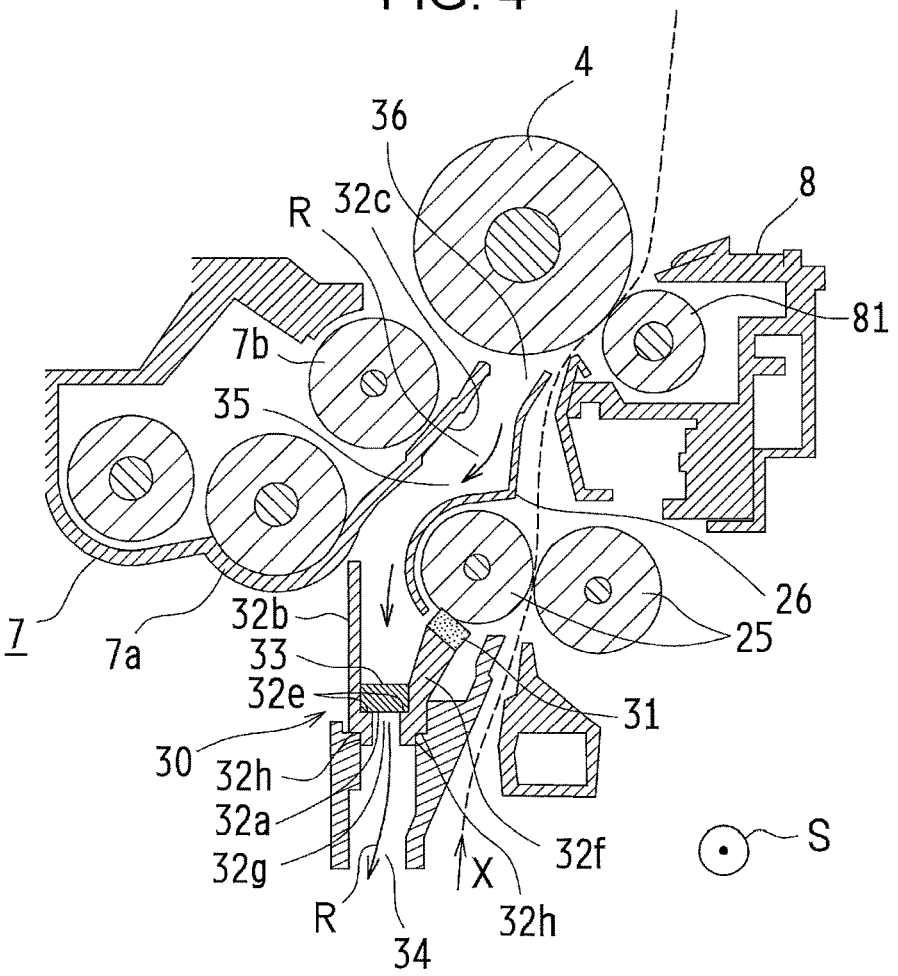
FIG. 4 is a schematic enlarged sectional view illustrating a main part of an image forming unit according to Embodiment 2 of the present disclosure.
Figure 5:
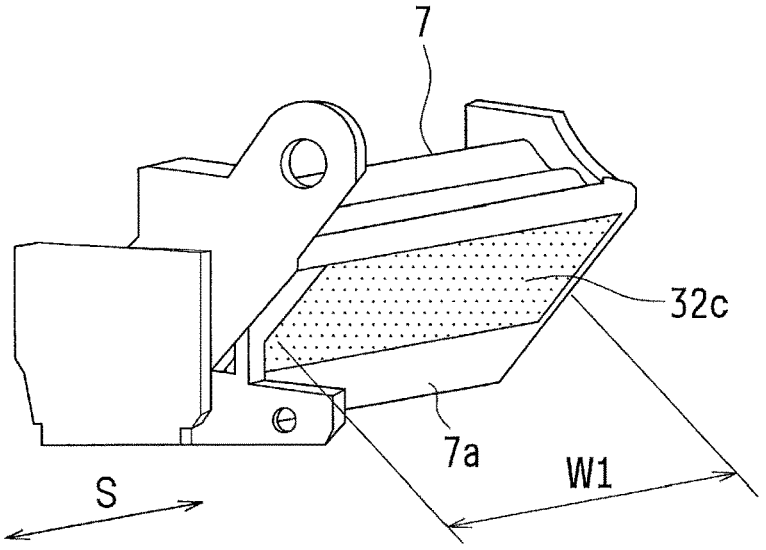
FIG. 5 is a perspective view illustrating a developing unit.

FIG. 4 is a schematic enlarged sectional view illustrating a main part of the image forming unit 103 according to Embodiment 2 of the present disclosure and FIG. 5 is a perspective view illustrating the developing unit 7.

In Embodiment 1, the paper dust collecting unit 30 is provided with the separation duct wall 32 facing the cover wall 26. However, in Embodiment 2, in addition to a first separation duct wall 32*b* formed on the paper dust collecting unit 30, the unit housing 7*a* of the developing unit 7 is used as a second separation duct wall 32*c*. That is, in Embodiment 2, the separation duct space 35 is formed by the cover wall 26, the first separation duct wall 32*b*, and the second separation duct wall 32*c*.

Specifically, the separation duct wall 32, which extends toward the photosensitive drum 4 from the bottom 32*a* in Embodiment 1, is formed as the first separation duct wall 32*b* which extends toward the unit housing 7*a* of the developing unit 7 in Embodiment 2. In addition, a wall portion of the developing unit 7 that is formed over an area from a position on the unit housing 7*a*, which the first separation duct wall 32*b* faces, to the photosensitive drum 4 is the second separation duct wall 32*c*. As with the first separation duct wall 32*b* formed on the paper dust collecting unit 30, the second separation duct wall 32*c* provided for the unit housing 7*a* has a length W1 (refer to FIG. 5) that is substantially the same as the axial length of the photosensitive drum 4.

A portion of the separation duct space 35 in Embodiment 2 at which the separation duct space 35 communicates with the apparatus fixation duct 34 is formed on the first separation duct wall 32*b* side and the opening 36 on the apparatus body 103*a* side is formed on the second separation duct wall 32*c* side. In addition, the collection path R through which powder (toner, paper dust, or like) scattering in the apparatus body 103*a* is collected is formed in the separation duct space 35, as with Embodiment 1.

As described above, in Embodiment 2, the unit housing 7*a* of the developing unit 7 is used as the second separation duct wall 32*c*. Therefore, it is more effectively use the installation space for the developing unit 7, specifically, the retreat space for the developing unit 7 as the separation duct space 35.

Embodiment 3

Figure 6:
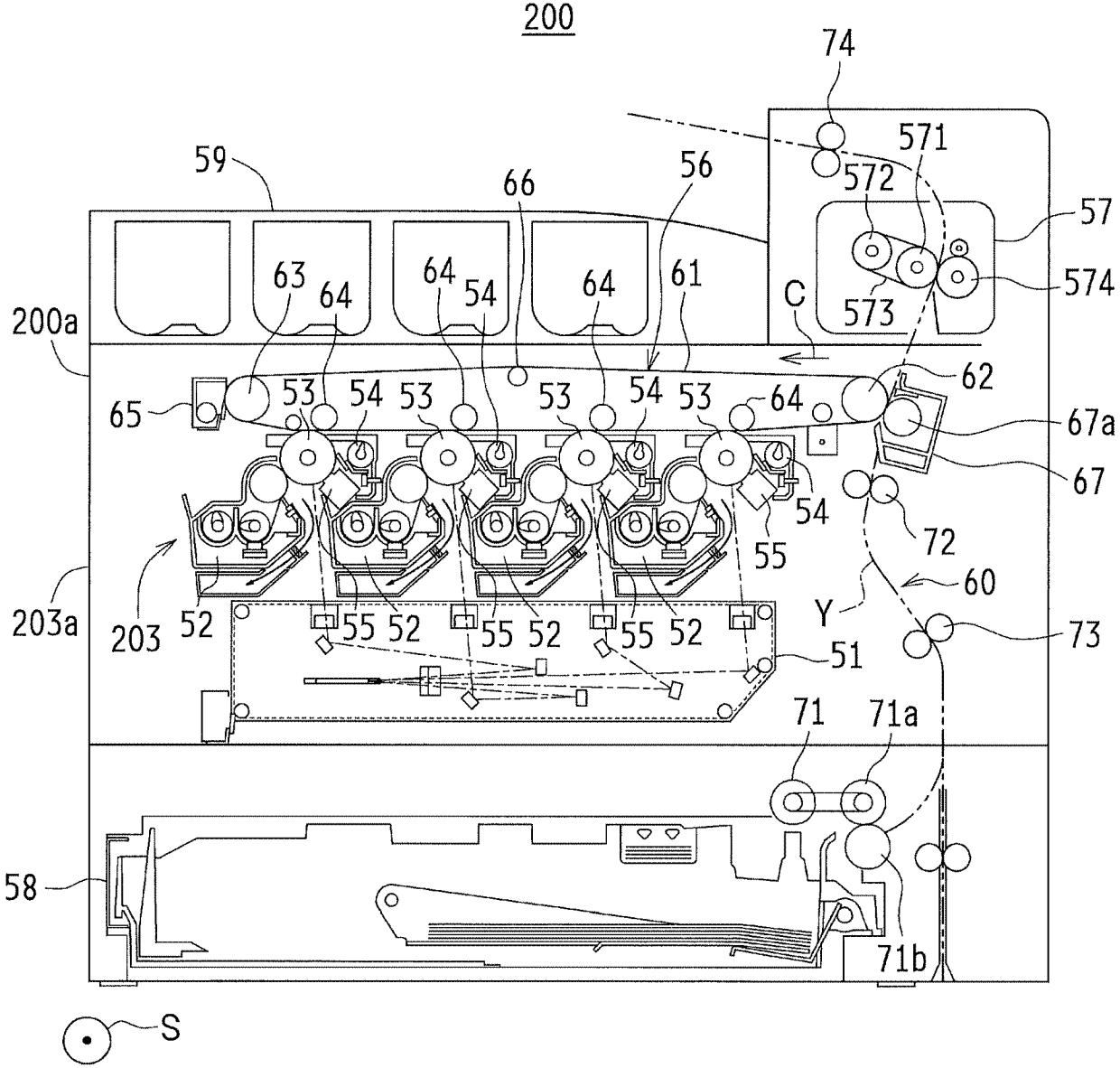
FIG. 6 is a schematic sectional view of an image forming apparatus according to Embodiment 3 of the present disclosure.

FIG. 6 is a schematic sectional view of an image forming apparatus according to Embodiment 3 of the present disclosure and illustrates a state where the present disclosure is applied to a color image forming apparatus. In addition, in FIG. 6, a document reading device is not shown.

An image forming apparatus 200 shown in FIG. 6 is provided with an image forming unit 203 that records and forms a color or monochrome image of a document read by the document reading device (not shown) or a color or monochrome image indicated by image data received from the outside on a paper sheet.

The image forming unit 203 is provided with an optical scanning unit 51, developing units 52 to 52, photosensitive drums 53 to 53 functioning as image carriers, cleaning units 54 to 54, electrification units 55 to 55, an intermediate transfer belt device 56 that includes intermediate transfer rollers 64 to 64 functioning as transfer units, a fixation device 57, a paper feed tray 58 functioning as a sheet feeding unit, a discharge tray 59 functioning as a discharge unit, and a paper sheet transportation device 60.

Image data handled in the image forming unit 203 is data corresponding to a color image which is formed by using colors of black (K), cyan (C), magenta (M), and yellow (Y) and data corresponding to monochrome image which is formed by using a single color (for example, black). Therefore, four developing units 52 to 52, four photosensitive drums 53 to 53, four cleaning units 54 to 54, four electrification units 55 to 55, and four intermediate transfer rollers 64 to 64 are provided such that four kinds of images corresponding to the above-described colors are formed.

The intermediate transfer belt device 56 disposed above the photosensitive drums 53 to 53 is provided with an intermediate transfer belt 61, an intermediate belt driving roller 62, a driven roller 63, an intermediate transfer belt cleaning device 65, and a tension roller 66 in addition to the intermediate transfer rollers 64 to 64.

The intermediate belt driving roller 62, the driven roller 63, the intermediate transfer rollers 64 to 64, and the tension roller 66 support the intermediate transfer belt 61 in a stretching manner and cause the intermediate transfer belt 61 to circulate in a predetermined paper sheet transportation direction (direction C in FIG. 6). The intermediate transfer rollers 64 to 64 are rotatably supported inside the intermediate transfer belt 61 and are in pressure-contact with the photosensitive drums 53 to 53 via the intermediate transfer belt 61. The intermediate transfer belt 61 is provided to be in contact with the photosensitive drums 53 to 53 and toner images on surfaces of the photosensitive drums 53 to 53 are sequentially transferred onto the intermediate transfer belt 61 in a superimposing manner such that a color toner image (toner image of each color) is formed. The transfer of the toner images from the photosensitive drums 53 to 53 to the intermediate transfer belt 61 is performed by the intermediate transfer rollers 64 to 64 being in press-contact with an inner side (rear surface) of the intermediate transfer belt 61. A high-voltage transfer bias for transferring the toner image is applied to the intermediate transfer rollers 64 to 64.

The image forming unit 203 is further provided with a secondary transfer device 67 that includes a transfer roller 67*a* functioning as a transfer unit. The transfer roller 67*a* is in contact with an outer side of the intermediate transfer belt 61. As described above, the toner image of each color laminated on the intermediate transfer belt 61 is transported along with the intermediate transfer belt 61 and is transferred onto a paper sheet by the secondary transfer device 67. A voltage for transferring the toner image of each color on the intermediate transfer belt 61 onto the paper sheet is applied to the transfer roller 67*a*.

The intermediate transfer belt cleaning device 65 removes and collects toner remaining on the intermediate transfer belt 61.

The paper feed tray 58 is a tray for storing paper sheets and is provided below the image forming unit 203. In addition, the discharge tray 59 provided above the image forming unit 203 is a tray on which paper sheets subject to printing are placed facing down.

In addition, an apparatus body 200*a* of the image forming apparatus 200 is provided with the paper sheet transportation device 60 for transporting a paper sheet in the paper feed tray 58 to the discharge tray 59 via the secondary transfer device 67 or the fixation device 57. The paper sheet transportation device 60 includes an S-shaped paper sheet transportation path Y and a pickup roller 71, a pair of separation rollers 71*a* and 71*b*, resist rollers 72, pre-resist rollers 73, the fixation device 57, and discharge rollers 74 are disposed along the paper sheet transportation path Y.

The fixation device 57 is a belt fixation type fixation device and a fixation belt 573 (example of rotary fixation member) is wound on a plurality of rollers (here, fixation roller 571 and heating roller 572). The fixation device 57 is configured such that a pressing roller 574 is pressed against the fixation roller 571 via the fixation belt 573.

Hereinabove, the entire configuration of the image forming apparatus 200 has been described.

Figure 7:
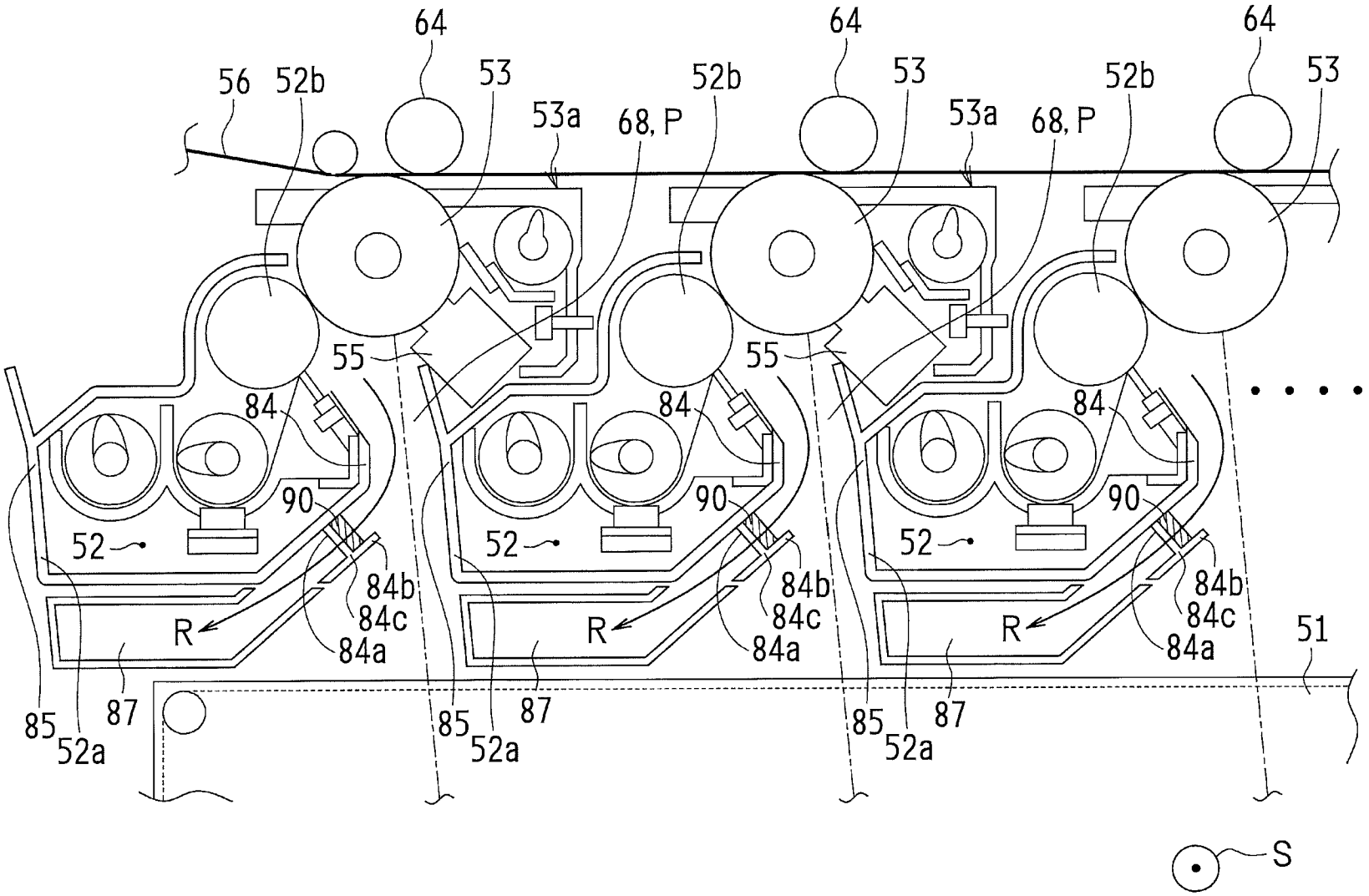
FIG. 7 is a schematic enlarged sectional view illustrating a main part of an image forming unit.
Figure 8:
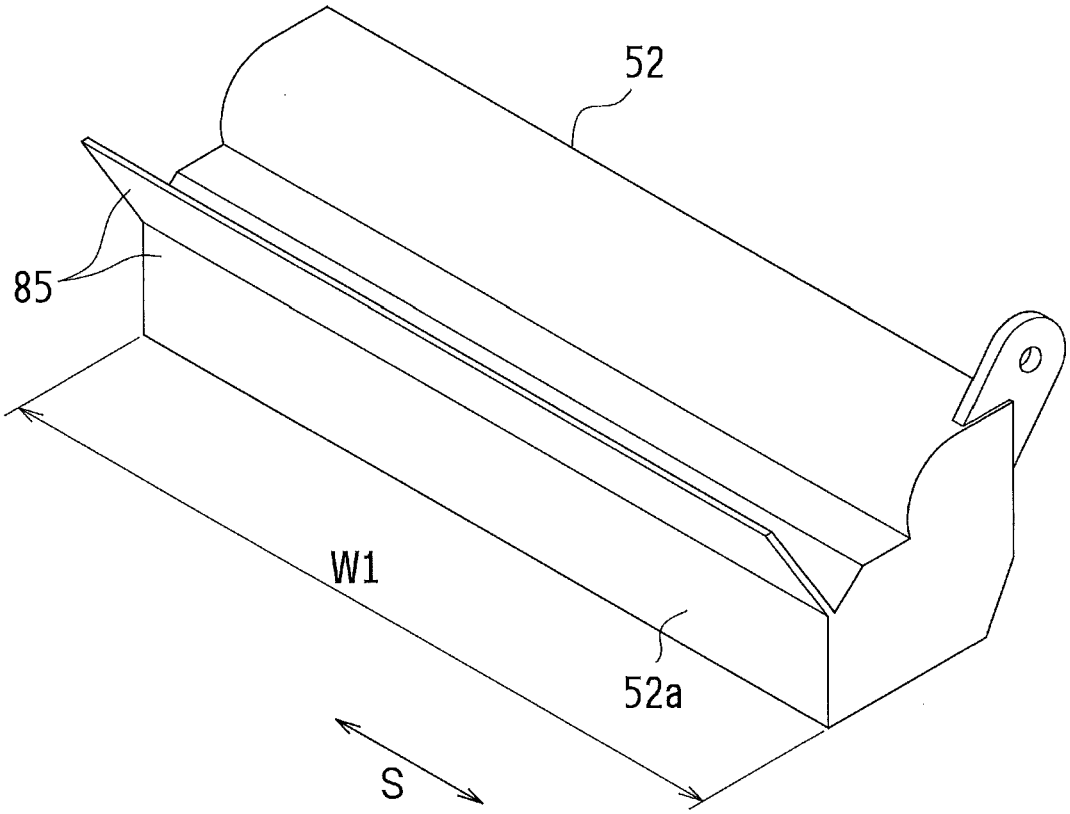
FIG. 8 is a perspective view of a developing unit.

FIG. 7 is a schematic enlarged sectional view illustrating a main part of the image forming unit 203 and FIG. 8 is a perspective view of a developing unit.

As shown in FIG. 7, in the image forming unit 203, the developing units 52 to 52 corresponding to colors of black (K), cyan (C), magenta (M), and yellow (Y) are disposed with gaps 68 to 68 provided therebetween in a transverse direction and the photosensitive drums 53 to 53 (photosensitive units 53*a* to 53*a*) are disposed above the gaps 68 to 68. The gaps 68 of the developing units 52 to 52 adjacent to each other are used as optical writing paths P to P of an optical system that writes an electrostatic latent image on the photosensitive drums 53 to 53.

The developing units 52 to 52 are replaceable components which can be inserted into and extracted from the apparatus body 203*a* (refer to FIG. 6) and as with Embodiment 1 and Embodiment 2, when detaching the developing units 52 to 52 from the apparatus body 203*a*, it is possible to detach the developing units 52 to 52 by moving the developing units 52 to 52 in a longitudinal direction (insertion and extraction direction S in FIG. 7) after moving the developing units 52 to 52 to retreat positions separated from the photosensitive drums 53 to 53 once. However, in Embodiment 3, retreat of the developing units 52 to 52 is performed by using the gaps 68 to 68 between the developing units 52 to 52 adjacent to each other. Therefore, a retreat direction of the developing units 52 to 52 is a leftward direction in FIG. 7.

In Embodiment 3, the gaps 68 to 68 are also used as collection paths R to R through which powder (toner, paper dust, or the like) scattering in the apparatus body 203*a* is collected. Therefore, separation duct walls 84 to 84 on one end side are formed close to developing rollers 52*b* to 52*b* of unit housings 52*a* to 52*a* of the developing units 52 to 52 and separation duct walls 85 to 85 on the other end side are formed on the unit housings 52*a* to 52*a* of the developing units 52 to 52 facing the separation duct walls 84 to 84 on the one end side. The separation duct walls 84 to 84 on the one end side and the separation duct walls 85 to 85 on the other end side extend toward the photosensitive drums 53 to 53 and openings at which the separation duct walls 84 to 84 on the one end side and the separation duct walls 85 to 85 on the other end side face each other are provided near the photosensitive drums 53 to 53. Since all of the developing units 52 to 52 have the same specifications and have the same shape, the unit housings 52*a* to 52*a* of the developing units 52 to 52 are formed with the separation duct walls 84 to 84 on the one end side that are positioned close to the developing rollers 52*b* to 52*b* and the separation duct walls 85 to 85 on the other end side that are positioned opposite to the developing rollers 52*b* to 52*b*. Therefore, the separation duct walls 84 to 84 on the one end side and the separation duct walls 85 to 85 on the other end side of the developing units 52 to 52 adjacent to each other face each other such that the collection paths R to R for powder are formed. The flow of air flowing in the collection paths R to R in a direction perpendicular to the paper surface of FIG. 7 is controlled by a wall portion of the apparatus body 203*a* and a wall portion provided as an opening door portion (not shown) for extraction of the developing units 52 to 52 or the like.

In addition, filter holding portions 84*a* to 84*a* provided with holding walls 84*b* to 84*b* are formed on the separation duct walls 84 to 84 on the one end side to hold filters 90 to 90. The holding walls 84*b* to 84*b* extend toward the photosensitive drums 53 to 53 while being positioned on the opposite sides of the filter holding portions 84*a* to 84*a* from the separation duct walls 84 to 84 on the one end side. Note that, the holding walls 84*b* to 84*b* are configured to protrude toward the gaps 68 to 68 from end surfaces 84*c* to 84*c* of the unit housings 52*a* to 52*a* to such an extent that the optical writing paths P to P are not blocked. The holding walls 84*b* to 84*b* and the filter holding portions 84*a* to 84*a* are formed along longitudinal directions of the developing units 52 to 52 (directions perpendicular to paper surface of FIG. 7) (insertion and extraction direction S) and the filter holding portions 84*a* to 84*a* are provided with communication ports through which the filter holding portions 84*a* to 84*a* communicate with apparatus fixation ducts 87 to 87 although not shown. Since the holding walls 84*b* to 84 have shapes protruding toward the gaps 68 to 68 further than the end surfaces 84*c* to 84*c*, air in the gaps 68 to 68 can be efficiently guided to the filters 90 to 90 and the communication ports.

An exhaust fan (not shown) is disposed in the apparatus fixation ducts 87 to 87 and air in the gaps 68 to 68 is sucked into the apparatus fixation ducts 87 to 87 via the filters 90 to 90 and the communication ports. The air sucked into the apparatus fixation ducts 87 to 87 flows toward a side opposite to an extraction opening (not shown) for the developing units 52 to 52 provided in the apparatus body 203*a* (in FIG. 7, in direction to deeper side of paper surface) and is discharged to the outside of the apparatus body 203*a* via an exhaust port (not shown). Note that, the plurality of apparatus fixation ducts 87 to 87 join each other at a deeper side of the paper surface of FIG. 7 and the exhaust fan is disposed in a region in which the plurality of apparatus fixation ducts 87 to 87 join each other.

Note that, the separation duct walls 84 to 84 on the one end side, the separation duct walls 85 to 85 on the other end side, the filter holding portions 84*a* to 84*a*, the holding walls 84*b* to 84*b*, and the filters 90 to 90 are formed to have the substantially same width W1 (refer to FIG. 8) as the axial length of the photosensitive drums 53 to 53. The opening is configured to be shorter than the width W1.

In addition, gaps between the apparatus fixation ducts 87 to 87 and the separation duct walls 84 to 84 on the one end side and gaps between the apparatus fixation ducts 87 to 87 and the holding walls 84*b* to 84*b* may be sealed by elastic members or the like such as sponge or felt.

As described above, in Embodiment 3, focusing on a point that the unit housings 52*a* and 52*a* of two adjacent developing units 52 and 52 are disposed close to each other and dispose to face each other, the unit housings 52*a* and 52*a* disposed to face each other are used as duct walls (separation duct walls) forming the collection paths R and R. That is, since the unit housings 52*a* to 52*a* of the developing units 52 to 52 are provided with the separation duct walls 84 to 84 on the one end side and the separation duct walls 85 to 85 on the other end side, it is possible to extract separation duct walls 84 to 84 on the one end side and the separation duct walls 85 to 85 on the other end side forming the collection paths R to R only by extracting the developing units 52 to 52 and it is possible to easily remove powder such as toner or paper dust adhering to each separation duct wall.

Note that, the embodiments disclosed herein are illustrative in any respect and does not provide grounds for restrictive interpretation. Therefore, the technical scope of the present disclosure is not to be interpreted only based on the above-described embodiments and is defined based on the description in claims. Moreover, the technical scope of the present disclosure includes any modification having meaning and scope equivalent to those in the scope of claims.

The present disclosure contains subject matter related to that disclosed in Japanese Priority Patent Application JP 2018-011538 filed in the Japan Patent Office on Jan. 26, 2018, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. An image forming apparatus comprising a replacement unit that is capable of being inserted into and extracted from an apparatus body, wherein the replacement unit is provided with a separation duct wall that forms an air blowing path between the separation duct wall and a body interior wall provided in an installation space for the replacement unit in the apparatus body when the replacement unit is installed in the apparatus body.

2. The image forming apparatus according to claim 1, wherein the separation duct wall is disposed along a longitudinal direction of the replacement unit, and wherein one end of a space, which is formed by the separation duct wall and the body interior wall facing each other, in a direction along a surface of the separation duct wall that is orthogonal to the longitudinal direction communicates with an apparatus fixation duct in which an air blowing fan is provided, and an opening that is open to an inner space of the apparatus body is formed at the other end of the space that is opposite to the one end.

3. The image forming apparatus according to claim 1, wherein an end of the separation duct wall in a longitudinal direction of the replacement unit is provided with a side wall that controls a flow of air in the longitudinal direction.

4. The image forming apparatus according to claim 1, wherein the body interior wall provided in the apparatus body is a separation duct wall of another replacement unit installed in the apparatus body.

5. The image forming apparatus according to claim 1, wherein the body interior wall provided in the apparatus body is a cover wall covering a paper sheet transportation roller.

6. The image forming apparatus according to claim 2, wherein the replacement unit includes a filter that purifies air and a filter holding portion that holds the filter and that is provided with a communication port communicating with the apparatus fixation duct, and the filter holding portion is provided with a holding wall that is shorter than the separation duct wall in length in a direction orthogonal to the longitudinal direction and that holds the filter, the filter and the filter holding portion being on an apparatus fixation duct side of the separation duct wall, the holding wall being on a side of the filter holding portion opposite to the separation duct wall.

7. The image forming apparatus according to claim 6, wherein the holding wall of the filter holding portion is provided with a cleaning member that cleans a paper sheet transportation roller, and wherein the cleaning member abuts onto the paper sheet transportation roller at an exposure opening for the paper sheet transportation roller that is provided in a cover wall.

8. The image forming apparatus according to claim 4, wherein an insertion and extraction direction of the replacement unit is a longitudinal direction of the replacement unit.

9. The image forming apparatus according to claim 1, wherein the replacement unit is a developing device and the separation duct wall is a portion of a housing of the developing device.

* * * * *